US005697617A

United States Patent [19]

Egging

[11] Patent Number: 5,697,617

[45] Date of Patent: Dec. 16, 1997

[54] GAME

[75] Inventor: Keith J. Egging, Itasca, Ill.

[73] Assignee: Mattel, Inc., El Segundo, Calif.

[21] Appl. No.: 599,077

[22] Filed: Feb. 9, 1996

[51] Int. Cl.[6] ..... F41J 5/02

[52] U.S. Cl. ..... 273/396; 273/389; 273/375

[58] Field of Search ..... 273/389, 375, 273/383, 378, 379, 371, 374, 376, 440, 447

[56] References Cited

U.S. PATENT DOCUMENTS

| | | | |
|---|---|---|---|
| 768,397 | 8/1904 | Norton et al. | 273/389 |
| 3,120,958 | 2/1964 | Glass et al. | 273/383 |
| 3,572,712 | 3/1971 | Vick | 273/375 |

FOREIGN PATENT DOCUMENTS

| | | | |
|---|---|---|---|
| 19150 | 7/1935 | Australia | 273/375 |
| 618847 | 8/1935 | Germany | 273/375 |
| 955784 | 4/1964 | United Kingdom | 273/375 |

*Primary Examiner*—Mark S. Graham
*Attorney, Agent, or Firm*—Patnaude, Videbeck & Marsh

[57] ABSTRACT

A game includes the head of an animal having a pair of jaws therein which are movable from an opened condition to a closed condition. The jaws are adapted to close upon a play object tossed between them, and a conveyor returns fallen play objects back to the contestants play position. A contestants score is determined by the number of play objects caught between the teeth of the animal head during the play time of the game.

12 Claims, 6 Drawing Sheets

GAME

The present invention relates to amusement devices of the type generally referred to as arcade games, and a particular to games of the type which test a contestants ability to throw an object.

BACKGROUND OF THE INVENTION

Commercial amusement devices are activated when a contestant inserts a coin, card or ticket in the proper receptacle, after which the contestant enters the scenario of the game and applies his skill to achieve certain goals. The contestants success is measured by calculating the total of the scores from a multitude of efforts made by the contestant during the play time of the amusement device. When a number of contestants use the same amusement device, the scores of the various contestants can be compared to rank their respective success. To be successful, it is desirable that the amusement device be physically attractive, provide a test of some skill of the participant, and finally, that the scenario of the device be of interest to the participant. A game scenario that is different from that of other games and is of interest to potential participants will attract participants to use the device.

SUMMARY OF THE INVENTION

Briefly, the present invention is embodied in an amusement device having a pair of opposing jaws configured as the jaws of an animal, such as a dog, the jaws movable between an open condition and a closed condition. In one embodiment a spring between the upper jaw member and lower jaw member draws the lower jaw upwardly towards the upper jaw member and into the closed condition. In the play condition, the jaws are wedged open by a collapsible brace which extends between the upper jaw member and lower jaw member, and a trigger is connected to the collapsible brace. When a contestant tosses a play object which passes between the jaws and contacts the trigger, the brace will collapse and the jaws will snap shut around the play object.

A first sensor detects movement of the jaws away from a fully opened condition and a second sensor detects movement of the jaws to the fully closed position. A signal from the first sensor that the jaws have moved away from the fully opened position followed by a signal from the second sensor that the jaws have moved to a fully closed position indicates that a play object has not been caught between the jaws. On the other hand, a signal from the first sensor that the jaws have moved away from the fully open condition which is not followed by a signal from the second sensor that the jaws have reached the fully closed condition indicates that a play object has been caught between the jaws.

In the preferred embodiment, the dog head of the animal is moveable upon a play field and a game is configured to space a contestant a distance from the jaws. To play the game, a contestant tosses a play object, such as a ball, a disk, or an aerodynamic disk sold under the trademark FRISBEE into the moving jaws of the dog. A conveyor collects play objects which are released from the jaws or fall without having been caught and delivers them to the play position for re-use by the contestant.

In another embodiment of the invention, optical sensors positioned within the jaws detect the movement of a play object between the jaws, and one or more electric solenoids control the opening and closing of the jaws.

GENERAL DESCRIPTION OF THE DRAWINGS

A better and more complete understanding will be had from a reading of the following detailed description taken in conjunction with the accompanying drawings in which.

DETAILED DESCRIPTION OF PREFERRED EMBODIMENT

Figure 1:
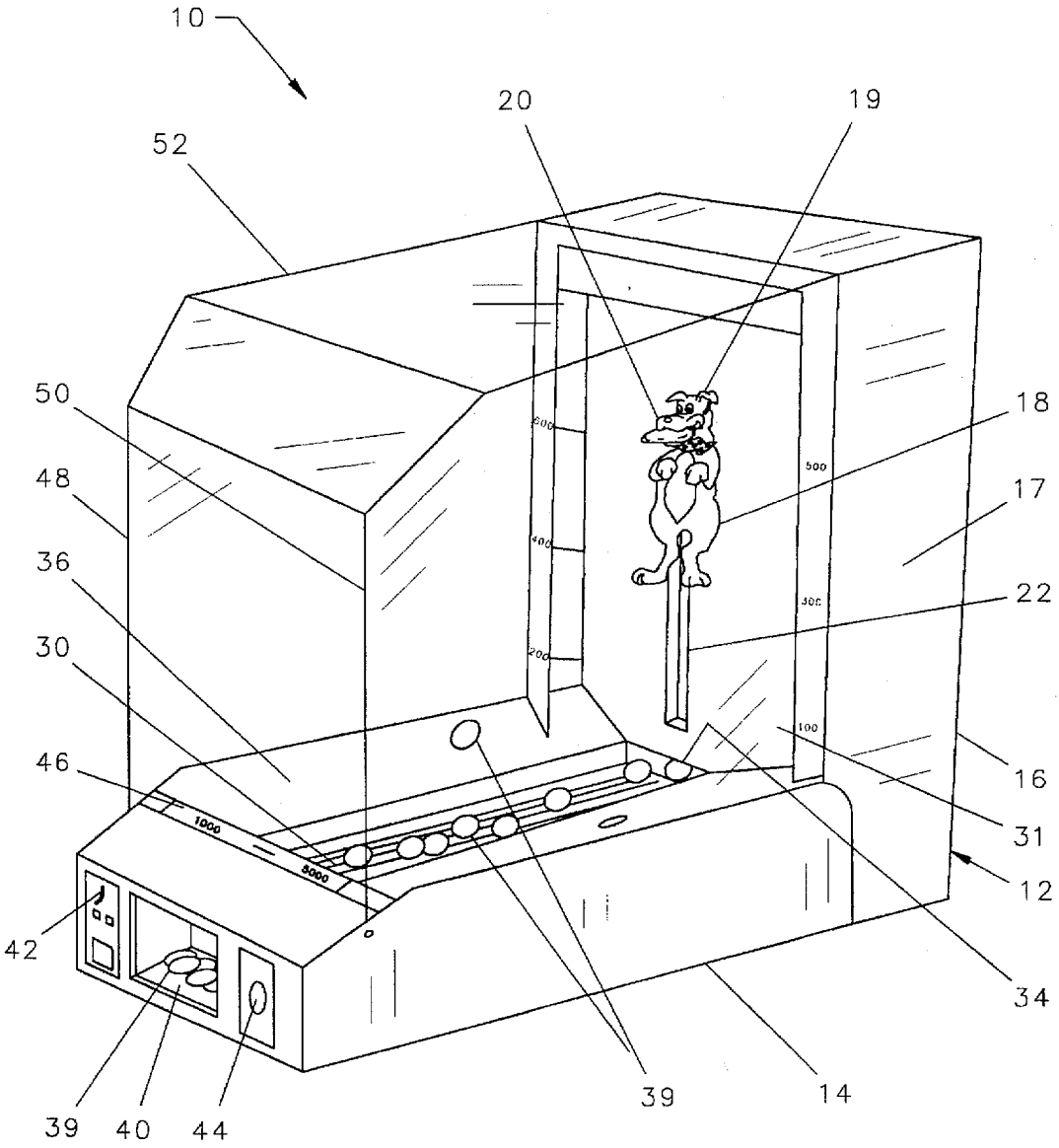
FIG. 1 is an isometric view of a game embodying the present invention.

Referring to FIG. 1, a game 10 in accordance with present invention is mounted on a frame 12 having an elongate horizontal arm 14 and a vertical box shaped back 16. The arm 14 and back 16 assembly are bordered by side panels, one of which, 17 is visible. For the purposes of this description, the arm 14 will be described as being positioned forward, or forwardly of the back 14, and the back will be described as being rearward or rearwardly of the arm.

Movably mounted on the forward surface of the back 16 is an animal model 18 in the shape of a dog, and within the head 19 of the dog are a pair of opposing jaws 20. In the preferred embodiment, the jaws 20 are mounted on a vertical a track 22 and moved by a variable speed motor and gear assembly 24 (shown only in FIGS. 6 and 7). The jaws 20 move vertically along the track 22 across a play field formed on a board 31 which forms the forward surface of the back 16.

A conveyor belt 30 extends along the center of the upper surface of the arm 14, with a first roller, (not shown) at one end of the belt 30 positioned behind the forward board 31 such that the belt 30 extends through a rectangular opening 34 in the forward board 31 of the back 16. The upper surfaces 36, 38 of the arm 14 are slopped downwardly from the sides toward the belt 30 such that play objects 39 which have been thrown by contestants against the forward board 31 and fall upon the upper surfaces 36, 38 will be directed towards the conveyor belt 30.

At the second end of the conveyor belt 30 is a second roller, not shown, positioned at the forward end 32 of the arm 14 above a tray 40 such that play objects which are collected by the conveyor belt 30 are deposited into the tray 40. The conveyor 30 is driven by a motor 41 shown only in FIGS. 6 and 7.

The forward end 32 of the arm 14 further has a coin deposit receptacle 42, a speed control 44 and a digital read out 46 for displaying the contestants score. Extending horizontally along each of the sides 17 of the amusement device 10 are opposing transparent side panels 48, 50 and extending along the upper edges of the side panels 48, 50 to the upper edge of the back FIG. 16 is a transparent top panel 52.

The amusement device 10 may be adapted to accept any of a number of shapes of a play object, such as balls, disks, or aerodynamic disks of the type sold under the Trademark Frisbee. A contestant, who desires to apply his skills against the test of the amusement device 10 will stand before the forward end 32 of the arm 14 and toss aerodynamic discs towards the jaws 20 on the play surface of the board 31, where the target consist of the jaws 20. A contestant can increase or decrease the difficulty of the device 10 by adjusting the speed control 44 and thereby regulating the speed of the motor and gear assembly 24 and the speed at which the dog moves along the tract 22. The contestant will commence the game by depositing a coin in the receptacle 42, and within the time allotted, tossing as many play objects 39 as he can at the jaws 20 and at any other targets provided on the play surface. His score will be tabulated and displayed in the read out 46, and the final score at the end of the play time will be the score awarded for his performance.

Figure 2:
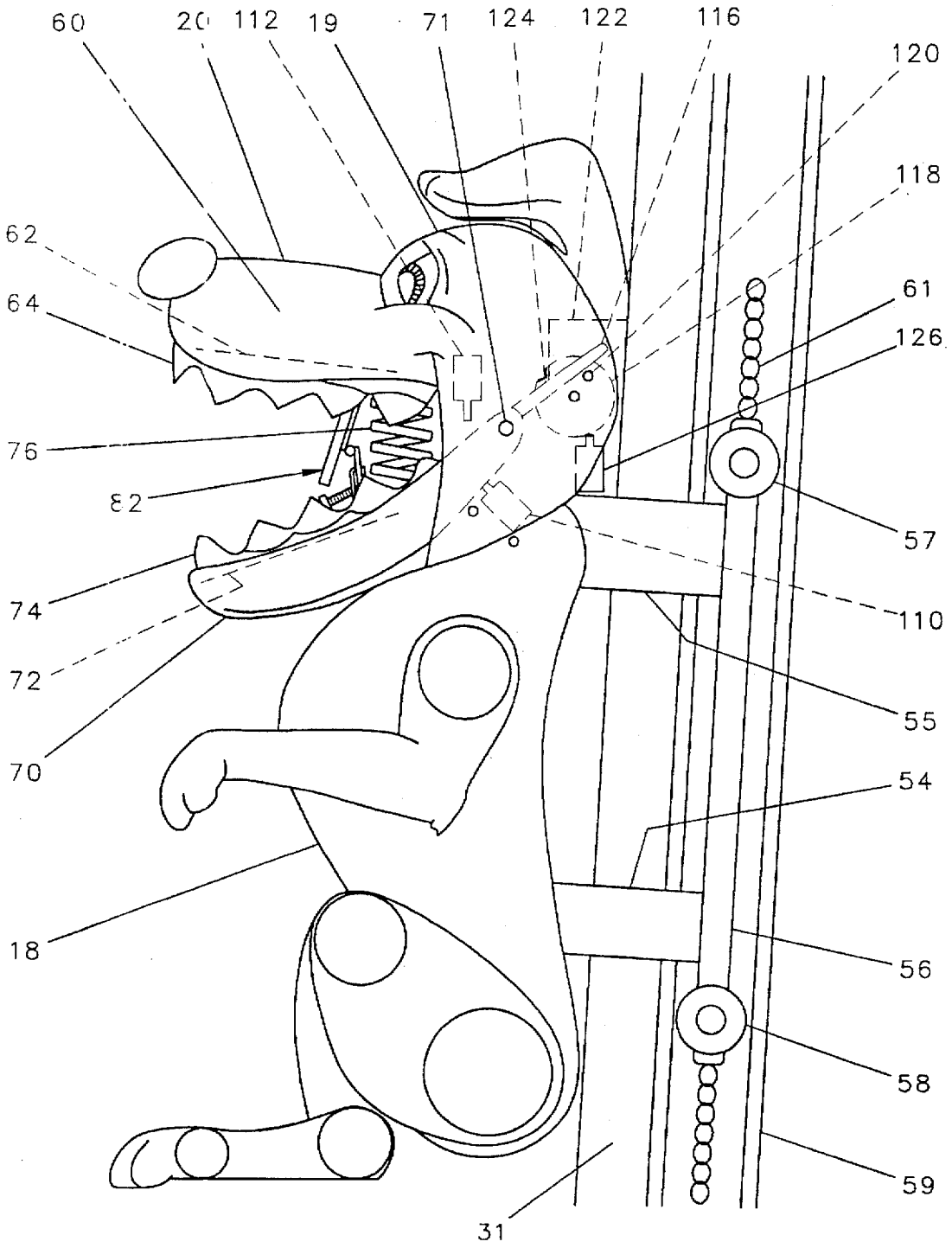
FIG. 2 is an enlarged side view of the assembly of opposing jaws in the opened condition, with portions of the assembly shown in phantom lines.
Figure 3:
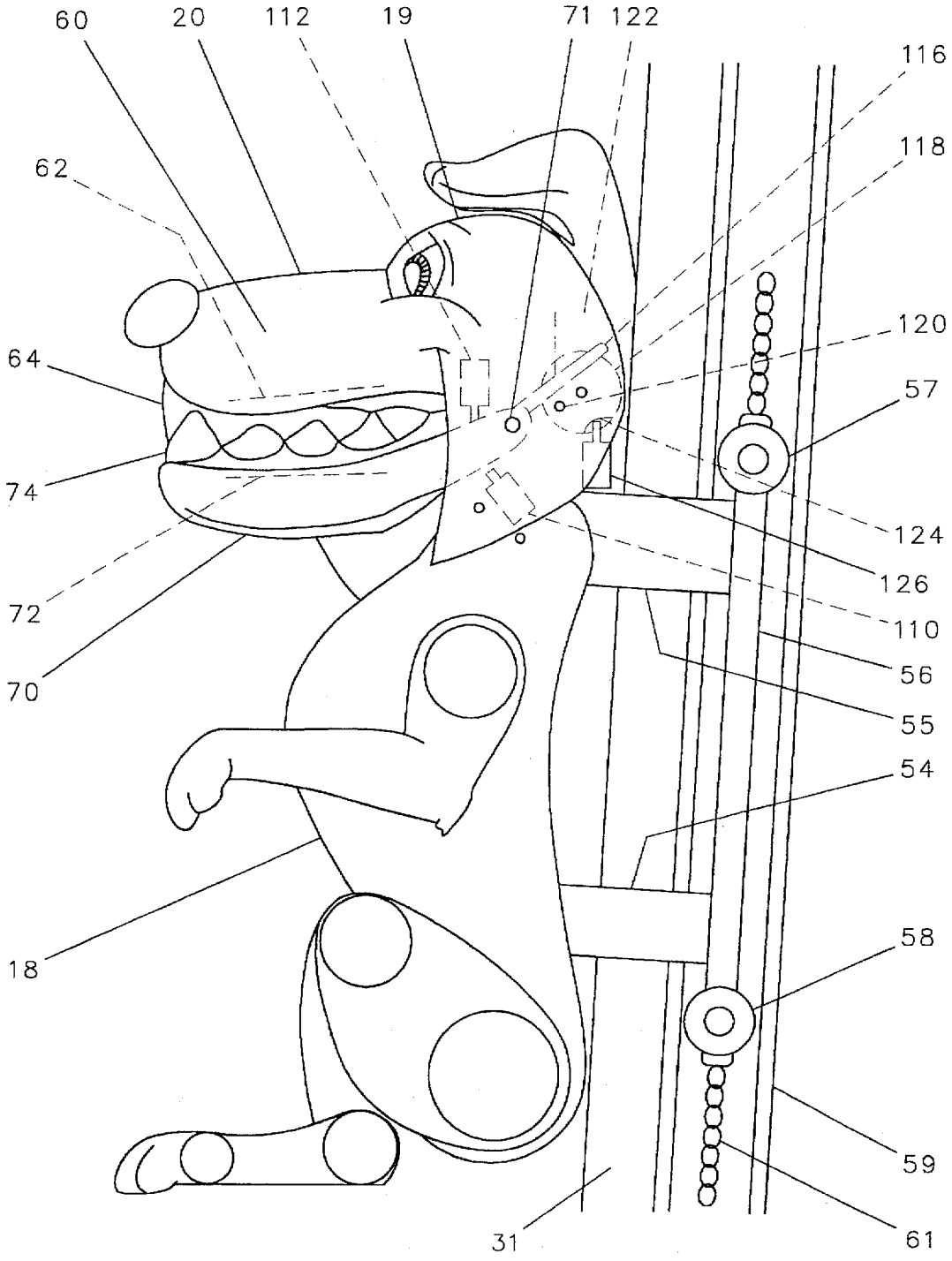
FIG. 3 is an enlarged side view of the assembly of opposing jaws in the closed condition with portions thereof shown in phantom lines.

Referring to FIGS. 2 and 3 the dog 18 and the jaws 20 are retained on a pair of mountings arm 54, 55 the rearward ends of which are secured to a cart 56 having upper and lower wheels 57, 58 respectively, for movement within a vertical track 59 which is secured to the rear surface of the forward panel 31. The cart 54, with the dog 18 and the jaws 20 attached thereto is moved upwardly or downwardly by a chain 61 driven by the motor 41 (shown in FIGS. 6 and 7) along the track 59.

As can be seen, the upper jaw member 60 has a generally horizontal planar lower surface 62 and around the forward end and sides of the jaw 60 are a plurality of downwardly extending upper teeth 64. The lower jaw member 70 is pivotally mounted at its rear end on a pivot pin 71 for movement from an opened condition shown at FIG. 2 to a closed condition shown in FIG. 3. The lower jaw member 70 also has a generally planar upper surface 72 and around the forward end and sides of the lower jaw member 70 are a plurality of upwardly extending lower teeth 74. A pair of springs, are positioned one on each side of the lower jaw 70, one of which 76, can be partially seen in FIG. 2, the lower ends of which are attached to the lower jaw member 70 and the upper ends of which are anchored in the upper portion of the dog head 19. The springs 76 are biased to draw the lower jaw member 70 upwardly into the closed condition shown in FIG. 3.

Referring to FIGS. 2, 3, 4 and 5, the lower jaw member 70 is retained in the opened condition by a collapsible brace assembly 82. The brace assembly 82 includes an upper brace plate 84 the upper end of which is hingably attached at a first pivot 86 to the lower surface 62 of the upper jaw 60, and the lower end of which is hingably attached at a second pivot 88 to the upper end of a lower plate 90. The lower end of the lower brace plate 90 is hingably attached at a third pivot 92 to the upper surface 72 of the lower jaw member 70.

Figure 4:
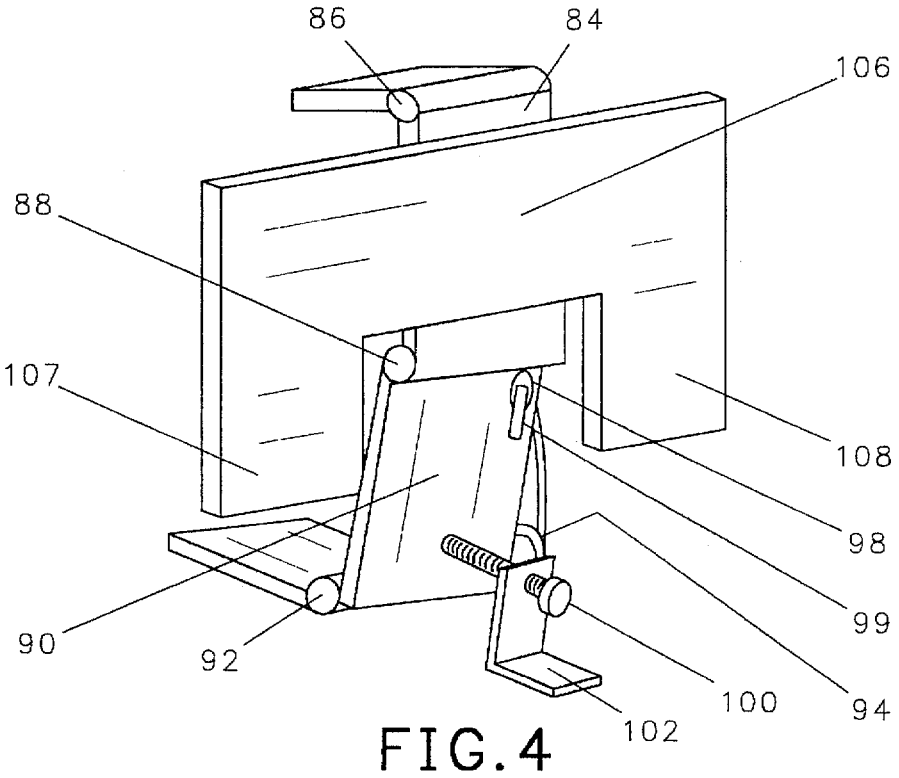
FIG. 4 is an enlarged isometric view of the trigger assembly.
Figure 5:
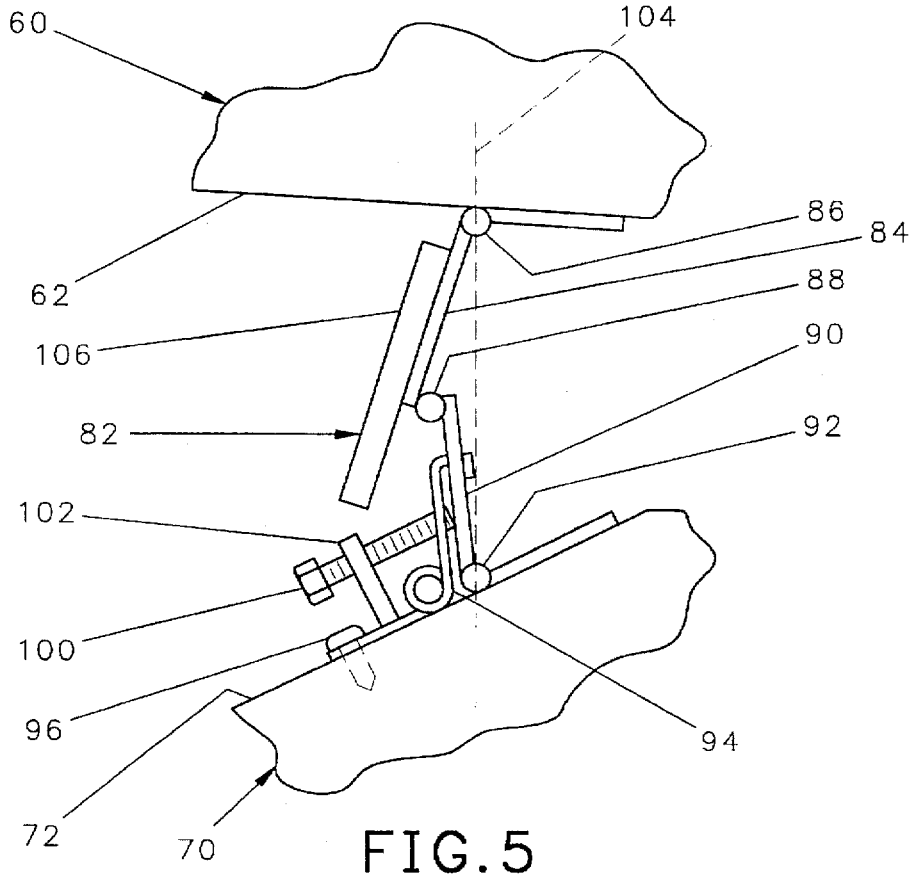
FIG. 5 is an enlarged side view of a trigger assembly shown in FIG. 4.

As best shown in FIG. 5, the lower brace plate 90 is biased to rotate its upper end toward the forward end of the lower jaw member 70 around the third pivot 92 by a coil spring 94 having one end thereof attached by a screw 96 to the upper surface 72 of the lower jaw member 70 and the other end thereof extended through a hole 98 in the lower brace plate 90 with the distal end 99 thereof bent, to retain the end of the spring 94 to the lower brace plate 90. As can be seen in both FIGS. 4 and 5, the forward rotation of the lower brace plate 90 about the third pivot hinge 92 is limited by the contact of the plate 90 against the distal end of a sensitivity screw 100 threaded through a support plate 102 which extends perpendicularly from the upper surface 72 of the lower jaw member 70. The lower jaw member 70 is retained in the open condition, as shown in FIG. 2, when the brace plates are aligned with the lower brace plate 90 abutted against the sensitivity screw 100 which has been adjusted to permit the axis of rotation of the second pivot 88 to be position forwardly of the plane 104 defined by the axis of rotation of the first pivot 86 and the third pivot 92 as shown in FIGS. 2, 4 and 5. Secured to the forward surface of the upper brace plate 84 is a trigger 106 configured as an inverted "U" having downwardly extending legs 107, 108 positioned on each side of the brace assembly 82.

As can be seen, when the lower jaw member 70 is moved to the open condition, shown in FIG. 2, the spring 94 will rotate the lower brace plate 90 about the third pivot 92 until the forward surface thereof contacts the distal end of the sensitivity screw 100. Where the sensitivity screw 100 has been adjusted to permit the axis of rotation of the second pivot 88 to be forward of the plane 104, the upper and lower brace plates 84, 90 will retain the lower jaw member in the open condition. In the event an object passes between the upper jaw member 60 and the lower jaw member 70 and contacts the forward surface of the trigger 106, the impact will push the axis of rotation of the second pivot 88 rearward of the plane 104, and the springs 76 on opposite side of the lower jaw member 70 will draw the lower jaw member 70 to the closed condition against the upper member 60.

Referring to FIGS. 2 and 3, a sensor 110 is positioned in the lower portion of the head 19 such that its sensing contact is depressed when the lower jaw 70 is retained in the opened condition by the brace assembly 82 as shown in FIG. 2. When the trigger 106 is struck by a play object and the brace assembly 82 is collapsed, the springs 76 draw the lower jaw away from the contact of the sensor 110. When the springs 76 draw the lower jaw 70 into the closed position shown in FIG. 3, the upper edge of the lower jaw 70 will depress a contact of a second sensor 112 signaling that the lower jaw 70 is in the jaw closed condition shown in FIG. 3.

To reset the lower jaw 70 into the opened condition, a jaw reset assembly 114 is provided at the back of the head 19. The jaw reset assembly 114 includes a reset arm 116 which is rigidly secured to the lower jaw 70 and extends rearward therefrom. A cam 118 having a peg 120 thereon is driven by a motor 122 and positioned with the axis of rotation thereof perpendicular to the plane defined by movement of the reset arm 116 as the lower jaw 70 rotates about the pivot pin 72. The cam 118 and peg 120 are positioned relative to the reset arm 116 such that the rotation of the cam and the upward movement of the peg 120 will force the reset arm 116 upwardly, and conversely move the lower jaw 70 downwardly to the opened condition. The lower jaw will therefore be reset by the movement of the peg 120 from a low position relative to the center of the cam as shown in FIG. 3 to a high position relative to the center of the cam as shown in FIG. 2. The cam 118 includes a detent 124 along the outer surface thereof, and a third sensor 126 having a depressible detector which is positioned against the edge of the cam 18 to detect the detent 124 when the peg 120 is in the low position as shown in FIG. 2.

Figure 6:
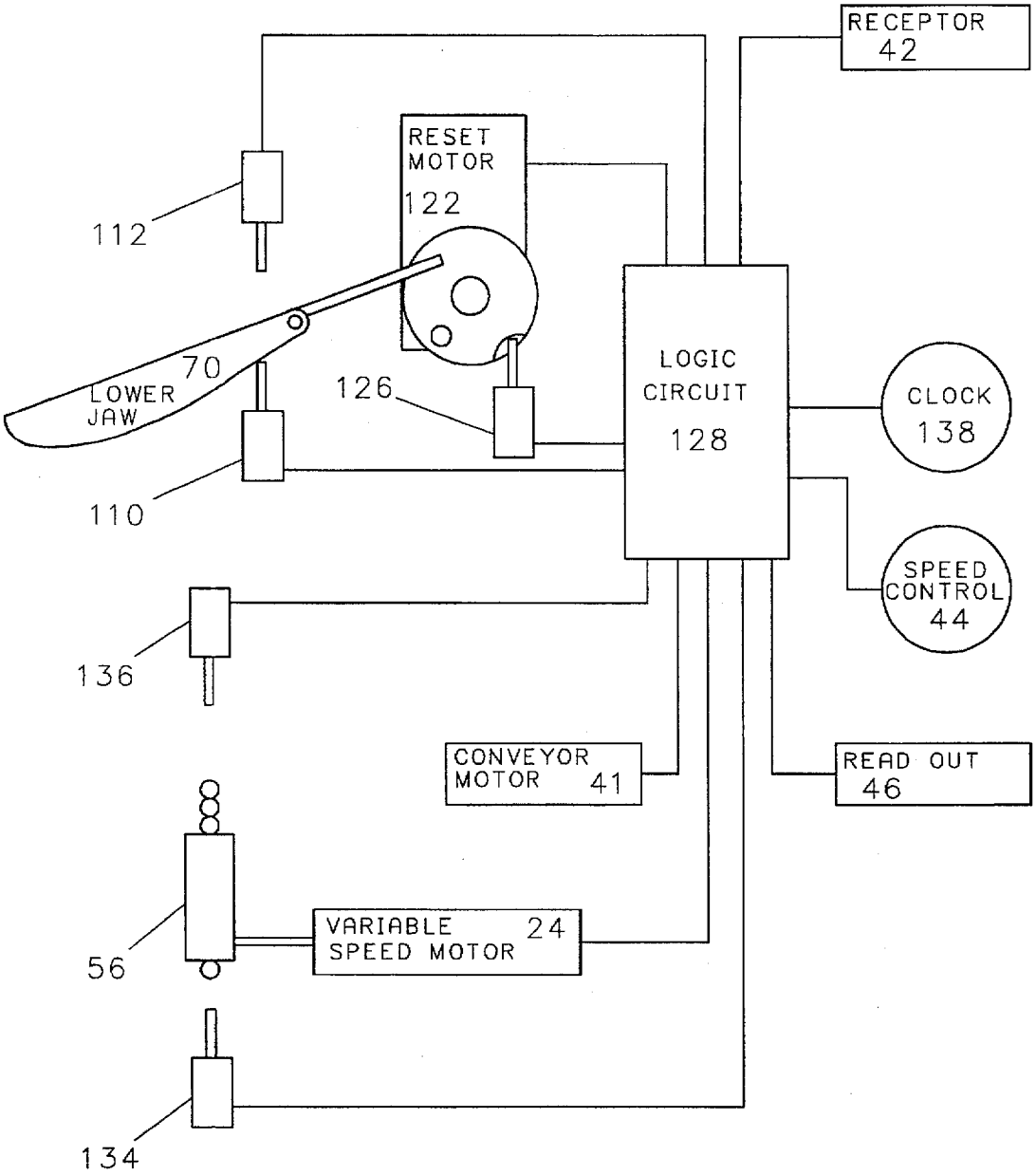
FIG. 6 is a blocked diagram of the circuit for the game shown in FIG. 1.

Referring to FIG. 6, the circuit for operating the present invention includes a logic circuit 128, which may be in the form a microprocessor which receives input from the first second and third sensors 110, 112, 126, respectively, and also from the coin receptor 42 and the speed control 44. The logic circuit 128 directs power to the conveyor motor 41, the variable speed motor 24 and the reset motor 122.

A fourth sensor 134 is actuated when the cart 56 is moved by the motor 24 and the chain 64 to the bottom of the tract 22, and a fifth sensor 136 is actuated when the cart reaches the top of the track, and the signal from the fourth and fifth detectors 134, 136, respectively are also received by the logic circuit 128. The logic circuit also receives inputs from the coin receptor 42 and the speed control 44, and provides an output into the digital readout 46. To control the length of the game, a clock 138 is also connected to the logic circuit. A contestant commences the game by depositing, a coin, or other appropriate input into the receptor 42, which sends a signal to the logic 128. The logic 128 then starts the clock 138 and sets the readout 46 to zero indicating that the game has commenced. Power will also be directed to the variable speed motor 24 causing the cart 56 and the connected dog 18 to move upwardly or downwardly along the tract 22. The logic 128 will reverse the direction of the motor 24 when either the fourth or fifth detectors 134, 136 is actuated indicating that the cart has reached the end of its tract as it moves in either of the upwardly or downwardly direction. The speed control 44 regulates the speed of the motor 24, and therefore the rate at which the dog 18 moves upwardly or downwardly along the tract 22.

When a contestant throws a play piece between the jaws 60, 70 and strikes the trigger 106, the lower jaw 70 will move away from the first sensor 110 and the logic 128 directs power to the reset motor 122. The reset motor 122 will rotate the cam 118 and the peg 120 will move the reset arm 116 upward and open the lower jaw 70 until the spring 80 in the brace assembly 82 repositions the brace assembly between the jaws. The cam 118 will continue to rotate until the peg 120 reaches the lower portion of the cam 118 and the third sensor 116 contacts the detent 124, at which time the logic 128 will terminate power to the reset motor 122.

In the event a play object 39 has been tossed between the jaws 60, 70, and the lower jaw 70 has closed upon the play object such that it is grasped between the teeth thereof as shown in FIG. 1, the second sensor 112 will not detect that the lower jaw 70 is in the jaw closed position because the jaws will be partially opened. The combination of an input from the first sensor 110 but none from the second sensor 112, will indicate that a play object has been caught between the jaws, and the logic will direct a score to the readout 46 which corresponds to a successful throw of a play object by the contestant.

When a play object is caught between the jaws 60, 70, the movement of the jaws will be detected by the first sensor 110 and the logic 128 will direct power to the motor 122. The lower jaw will therefore be reopened, and any play object caught between the upper and lower teeth will be dropped onto the upper surfaces 36, 38 and the conveyor belt 30 will move the play object to the collection tray 40 for reuse by the contestant. A successful contestant will toss a number of play objects between the jaws 60, 70 during the time allotted by the clock 138 and the logic 128 will add the scores of successive captures to that shown in the read out 46 until the time on the clock 138 expires.

During the course of the game, the contestant can use the speed control 44 to alter the speed of the motor 24, and thereby control the rate of which the cart 56 and dog 18 move upwardly or downwardly along the tract 22. Increasing or decreasing the speed of the motor 24, can also increase or decrease the value of the score shown on the readout 46 when a play object is captured between the jaws. The total score shown on the readout 46 at the expiration of the time on the clock 138 is the measure of a contestants success when a game is completed.

Figure 7:
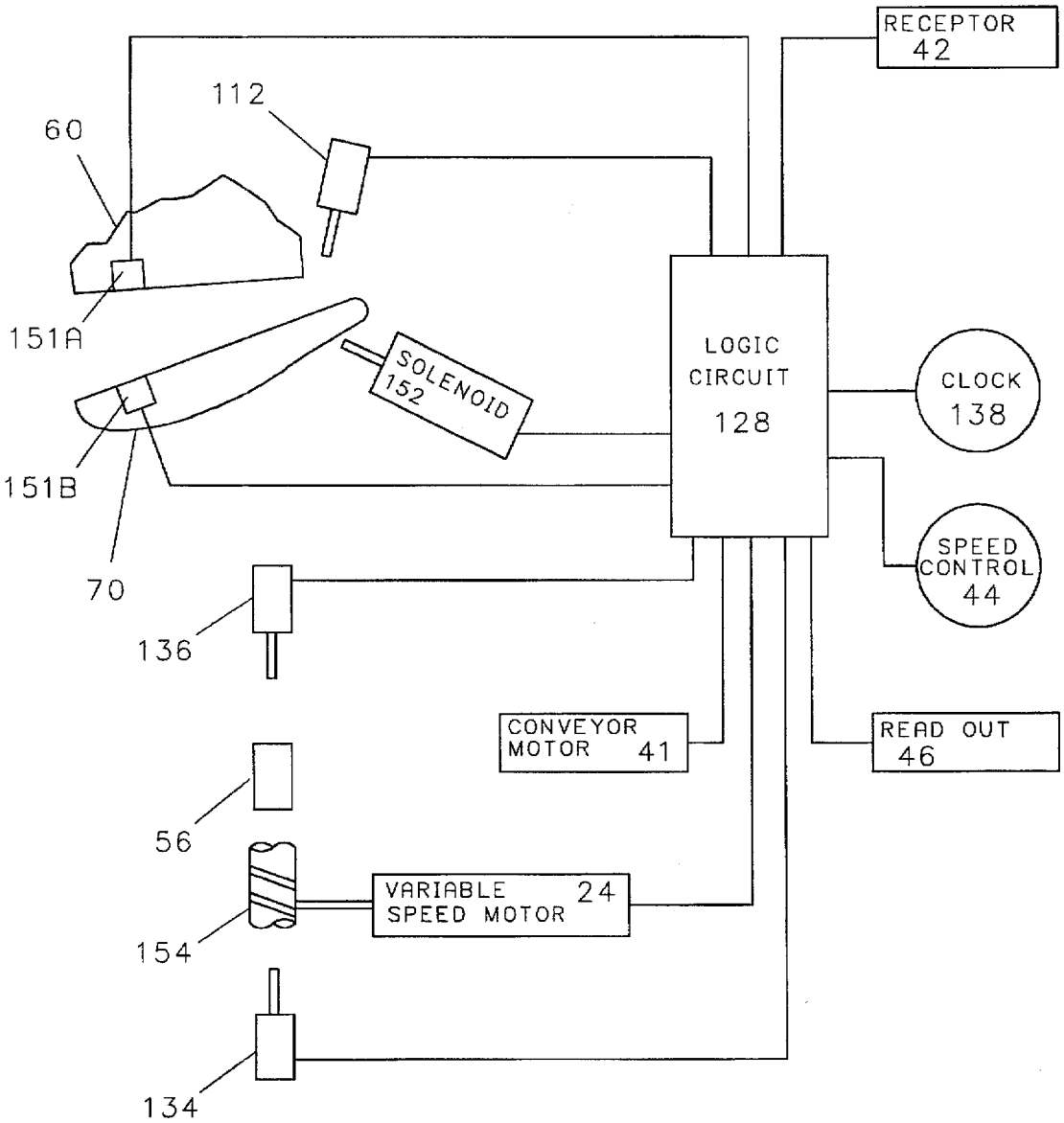
FIG. 7 is a block diagram of a second embodiment of a game in accordance with the present invention.

A second embodiment of the game is schematically shown in FIG. 7 in which elements which are identical to those shown in the first embodiment bear like indicia numbers. In this embodiment, the brace assembly 82 of the first embodiment is eliminated and replaced by an optical sensor having a first component 151A positioned in the upper jaw member 60, and a second component 151B positioned in the lower member 70. Also, there is an electric solenoid 152 having an armature which moves the lower jaw member 70 between the opened condition to a closed condition. The drive for moving the dog 18 upwardly and downwardly along the tract 22 may also be in the form of worm gear 154 driven by a motor 156.

Like the first embodiment, the game is commenced by a contestant depositing a coin into the receptor 42 after which the circuit 128 starts the clock 138, energizes the motor 156 and the conveyor motor 41 and sets the readout 46 to zero. The dog 18 is moved upwardly and downwardly along the tract 22, and its direction is reversed on input from the fourth and fifth sensors 134, 136 as in the first embodiment.

In this embodiment, however, when a play object passes between the jaws the logic 128 receives a signal from the optical sensors 151A, 151B and power is directed to the solenoid 152 to close the jaws. After the jaws have had sufficient time to clamp around a play object, the logic 128 directs power to the solenoid 152 to reopen the jaws thereby positioning them to catch another play object. In all other respects, the elements of the second embodiment operate as described with respect to the first embodiment. Therefore, there has been disclosed a game in which contestants can toss objects into the mouth of a toy animal and the contests success is scored on a readout.

While the present invention has been disclosed with respect to two embodiments, it will be apparent to those skilled in the art that many changes and modifications may be made without departing from the true spirit and scope of the invention. It is the purpose of the appended claim, therefore, to cover all such changes and modifications which fall within the true spirit and scope of the invention.

What is claimed:

1. A game comprising in combination, a pair of jaws movable from an opened condition to a closed condition, means for closing said jaws for capturing a play object moving between said jaws when said jaws are in said open condition;

reset means for re-opening said jaws to said open condition, and means for detecting that a play object has been captured between said jaws.

2. A game in accordance with claim 1 wherein said means for capturing includes a trigger.

3. A game in accordance with claim 1 wherein said pair of jaws are movable on a field of play.

4. A game in accordance with claim 1 and further comprising a play object.

5. A game in accordance with claim 1 and further comprising a means for returning a play object to a game play location.

6. A game in accordance with claim 1 and further comprising read out means for displaying a score.

7. A game in accordance with claim 1 wherein said means for detecting includes an optical sensor.

8. A game in accordance with claim 1 wherein said means for closing includes a solenoid.

9. A game in accordance with claim 1 wherein said means for detecting further comprises a first sensor for sensing that said jaws are in said opened condition, and a second sensor for sensing that said jaws are in said closed condition.

10. A game comprising in combination

A pair of opposing jaws, said jaws movable from an opened condition to a closed condition, jaw closing means for moving said jaws from said opened condition to said closed condition, means for retaining said jaws in an open condition, trigger means for releasing said means for retaining when a play object passes between said jaws, motorized opening means for re-opening said jaws to said opened condition after said jaws have been moved to said closed condition, and means for detecting that an object has been caught between said jaws.

11. A game in accordance with claim 10 and further comprising counting means for counting the number of objects caught between said jaws; and means for displaying a score.

12. A game comprising in combination

A pair of opposing jaws, said jaws movable from an opened condition to a closed condition, jaw closing means for moving said jaws from said opened condition to said closed condition, means for retaining said jaws in an open condition, trigger means for releasing said means for retaining when a play object passes between said jaws, motorized opening means for re-opening said jaws to said opened condition, after said jaws have been moved to said closed condition, and play object return means for returning play objects to a game play location.

* * * * *